US007059165B2

(12) United States Patent
Siegert et al.

(10) Patent No.: US 7,059,165 B2
(45) Date of Patent: Jun. 13, 2006

(54) HYDROMECHANICAL CLOSING DEVICE, IN PARTICULAR FOR LATERAL EXTRUSION

(75) Inventors: Klaus Siegert, Sindelfingen (DE); Aribert Schwager, Asperg (DE); Manfred Kammerer, Asperg (DE)

(73) Assignee: Hatebur Umformmaschinen AG, Reinach (CH)

( * ) Notice: Subject to any disclaimer, the term of this patent is extended or adjusted under 35 U.S.C. 154(b) by 158 days.

(21) Appl. No.: 10/475,483

(22) PCT Filed: Apr. 30, 2002

(86) PCT No.: PCT/CH02/00237

§ 371 (c)(1),
(2), (4) Date: Oct. 20, 2003

(87) PCT Pub. No.: WO02/092258

PCT Pub. Date: Nov. 21, 2002

(65) Prior Publication Data

US 2004/0129053 A1 Jul. 8, 2004

(30) Foreign Application Priority Data

May 11, 2001 (DE) ..... 101 23 745

(51) Int. Cl.
*B21J 9/12* (2006.01)
*B21J 9/10* (2006.01)

(52) U.S. Cl. ..... 72/355.6; 72/353.6; 72/352

(58) Field of Classification Search ..... 72/355.6, 72/354.6, 354.8, 355.2, 377, 453.05, 453.03
See application file for complete search history.

(56) References Cited

U.S. PATENT DOCUMENTS 4,977,773 A * 12/1990 Mito et al. ..... 72/353.6
5,195,349 A 3/1993 Ishinaga et al.

FOREIGN PATENT DOCUMENTS

DE 199 22 659 A1 5/1999
JP 55088945 7/1980
JP 05253696 10/1993

OTHER PUBLICATIONS

International Search Report PCT/CH02/00237—Dated Jul. 10, 2002.
Document Bibliography and Abstract—Hydraulic Closing-Device for the Lateral Extrusion of Workplaces Patent No. EP1053801, A3—Publication Date: Nov. 22, 2000, Corresponding to Patent: DE19922659.

* cited by examiner

*Primary Examiner*—Dennis H. Banks
*Assistant Examiner*—Debra M Wolfe
(74) *Attorney, Agent, or Firm*—Welsh & Katz, Ltd.

(57) ABSTRACT

The invention relates to a hydromechanical clamping device having two movable die halves and two punches, a first hydraulic piston, and a second hydraulic piston. The second die half is fixed to the frame and the second punch is arranged on the second hydraulic piston. The first hydraulic cylinder is connected to a third hydraulic cylinder. The latter acts on a fourth hydraulic piston. The first hydraulic cylinder is connected to the third hydraulic cylinder, so that the pressure medium displaced from the first hydraulic cylinder during a feed movement flows into the third hydraulic cylinder and the third hydraulic piston moves the fourth hydraulic piston in the feed direction, so that pressure medium is displaced into the second hydraulic cylinder, and the requisite forming pressure can be applied to the second hydraulic piston and the punches move toward one another.

17 Claims, 5 Drawing Sheets

HYDROMECHANICAL CLOSING DEVICE, IN PARTICULAR FOR LATERAL EXTRUSION

FIELD OF THE INVENTION

The invention relates to a hydromechanical closing device, in particular for the lateral extrusion of work pieces.

BACKGROUND OF THE INVENTION

During lateral extrusion, pressure is applied to a work piece between two punches in such a way that some of the material flows—transversely to the press direction—into cavities formed by die halves.

A hydraulic closing device for lateral extrusion of work pieces is disclosed according to DE 199 22 659 A1, this closing device having two die halves which can be moved relative to one another and can be closed together and two punches which can be moved at the same speeds relative to the closed die halves, a first hydraulic piston, on which the first die half is arranged, being mounted in a displaceable manner in an axially movable first hydraulic cylinder, and a second hydraulic piston being mounted in a displaceable manner in a spatially fixed second hydraulic cylinder. The first punch is fastened via a punch carrier to a supporting plate which is connected to the ram. The second die half is arranged in a spatially fixed manner, and the second punch is fastened to the second hydraulic piston, which during the lateral extrusion can be acted upon by a pressure medium which can be displaced by the first hydraulic piston. Both hydraulic pistons have the same piston areas. The first hydraulic cylinder is arranged on a press ram; the second die is arranged on the second hydraulic cylinder. Both hydraulic cylinders are connected via an external pressure line to a pressure system which can be fed with pressure medium. A disadvantage in this case is the external high-pressure hose connection between the two hydraulic cylinders, since use of this moving high-pressure hose is currently only admissible for pressures up to 1000 bar.

SUMMARY OF THE INVENTION

The object of the invention is to provide a closing device of the generic type, in particular for the lateral extrusion of work pieces, which has a simple and compact construction and is designed without an external pressure-medium connection between the first hydraulic cylinder and the second hydraulic cylinder.

In this case, the hydromechanical closing device has two die halves which can be moved relative to one another and which can be closed together and also two punches which can be moved at the same speeds relative to the closed die halves. The first die half is arranged on a first hydraulic piston, and in this case the first hydraulic piston is guided in an axially movable first hydraulic cylinder. Furthermore, a second hydraulic piston is mounted in a displaceable manner in a second hydraulic cylinder fixed to the frame. The second die half is fixed to the frame and the second punch is arranged on the second hydraulic piston. According to the invention

- the first hydraulic cylinder is connected to at least one third hydraulic cylinder, in which a third hydraulic piston is guided,
- the third hydraulic piston, in the closed state of the closing device, acts on a fourth hydraulic piston, which is guided in a fourth hydraulic cylinder fixed to the frame and is connected to the second hydraulic cylinder,
- the pressure medium displaced from the first hydraulic cylinder during a feed movement flowing into the third hydraulic cylinder via the connection between the first and third hydraulic cylinders, so that the third hydraulic piston moves the fourth hydraulic piston in the feed direction,
- in such a way that pressure medium is displaceable from the fourth hydraulic cylinder by the fourth hydraulic piston into the second hydraulic cylinder and thus the requisite forming pressure can be applied to the second hydraulic piston, so that the punches move toward one another.

In this case, the third hydraulic piston and the fourth hydraulic piston may be designed, for example, as annular pistons and are preferably arranged in alignment with one another.

Furthermore, the third hydraulic piston and the fourth hydraulic piston may each be designed as a plurality of individual pistons and may be arranged on a common pitch circle. Likewise, the third hydraulic piston and the fourth hydraulic piston may each be designed as individual pistons which are arranged to the side of the first and the second hydraulic cylinder, respectively, and are preferably arranged in alignment with one another. In this case, the third hydraulic piston and the fourth hydraulic piston are preferably connected to one another via pressure rods.

In order to ensure the same magnitude of the feed movement of the two punches, the volume of the pressure medium which is displaced in the first and third hydraulic cylinders must be the same as the volume which is displaced in the second and fourth hydraulic cylinders, and the first hydraulic piston and the second hydraulic piston must have the same piston areas.

The piston area of the fourth hydraulic piston is established in accordance with the piston area of the second hydraulic piston and the distances covered by the third and fourth hydraulic pistons during the feed movement.

For example, the piston area of the fourth hydraulic piston is halved in relation to the piston area of the third hydraulic piston if the fourth hydraulic piston covers twice the distance as the third hydraulic piston. If the third hydraulic piston is formed from a total of 6 individual pistons having a total area $A_G$, the fourth hydraulic piston may consist of only three individual pistons having a total area $A_G/2$ if the individual pistons all have the same individual piston area. If there is the same number of individual pistons for the third and fourth hydraulic pistons (e.g. 6 of each), the individual area $A4_E$ of the individual pistons of the fourth hydraulic cylinder must be halved in relation to the individual area $A3_E$ of the individual pistons of the third hydraulic cylinder in order to obtain half the total area, i.e. $A4_E=A3_E/2$.

The first and the third hydraulic cylinder are fastened to the press ram, e.g. via an intermediate plate. The first punch is arranged on a pressure piece connected to the ram. As a result, the first and the third hydraulic cylinder as well as the first punch perform a feed movement of the same magnitude.

The second die half, the second hydraulic cylinder and the fourth hydraulic cylinder are arranged opposite one another on a base plate in such a way as to be fixed to the frame.

It is not until the inserted work piece begins to flow due to the applied pressure, i.e. the requisite yield stress is reached, that pressure medium can be forced from the fourth hydraulic cylinder into the second hydraulic cylinder by the fourth hydraulic piston, so that the second hydraulic piston and thus the second punch perform a corresponding movement by the same amount.

The hydraulic cylinders can be filled with pressure medium via a pressure line.

A compact and reliably working closing device which can also be used for very high pressures is provided by the invention.

BRIEF DESCRIPTION OF THE DRAWINGS

The invention is explained in more detail below with reference to three exemplary embodiments and associated drawings, in which.

DETAILED DESCRIPTION

Figure 1:
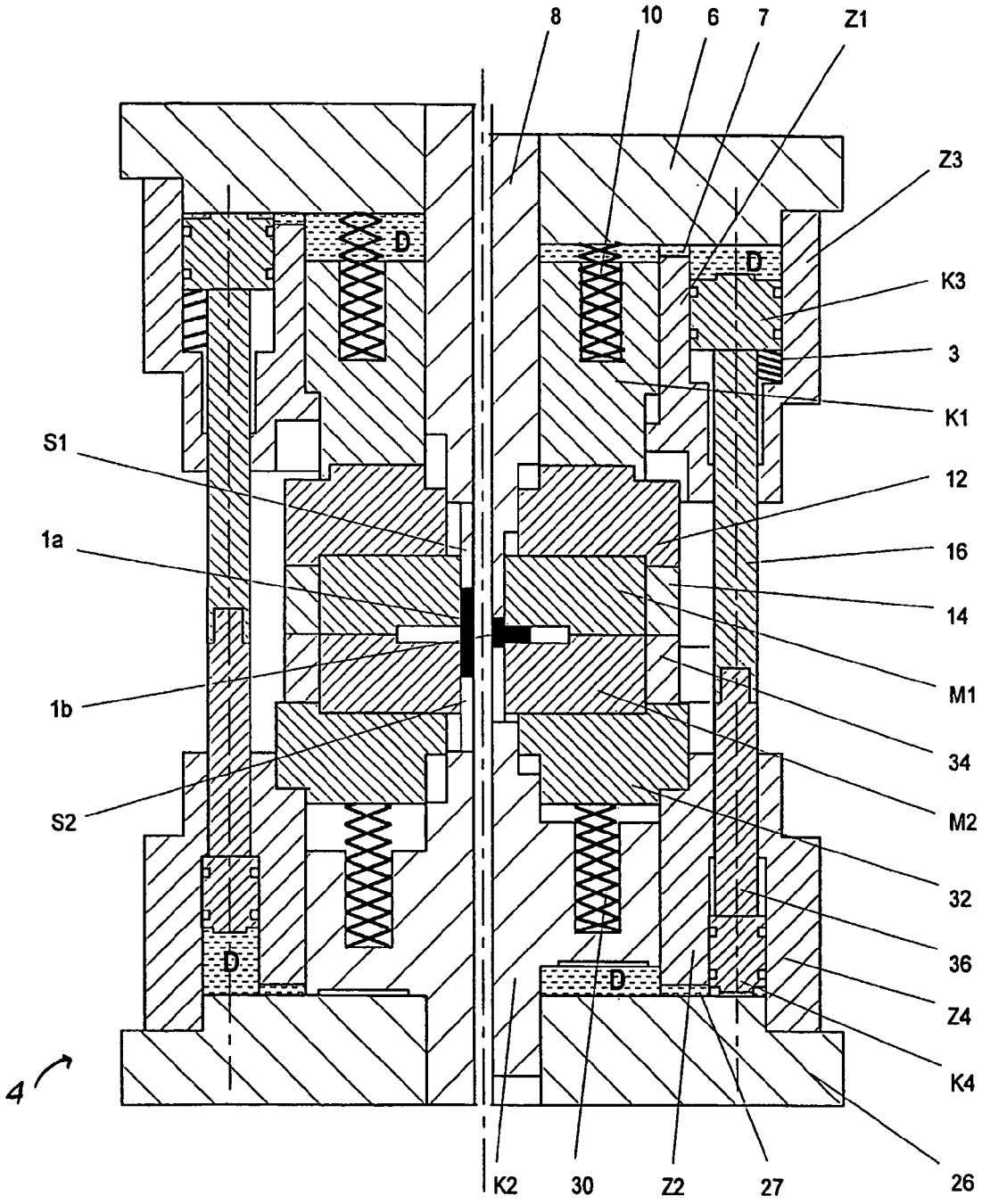
FIG. 1 shows a closing device, with third and fourth hydraulic pistons designed as annular pistons, of a first exemplary embodiment.
Figure 2:
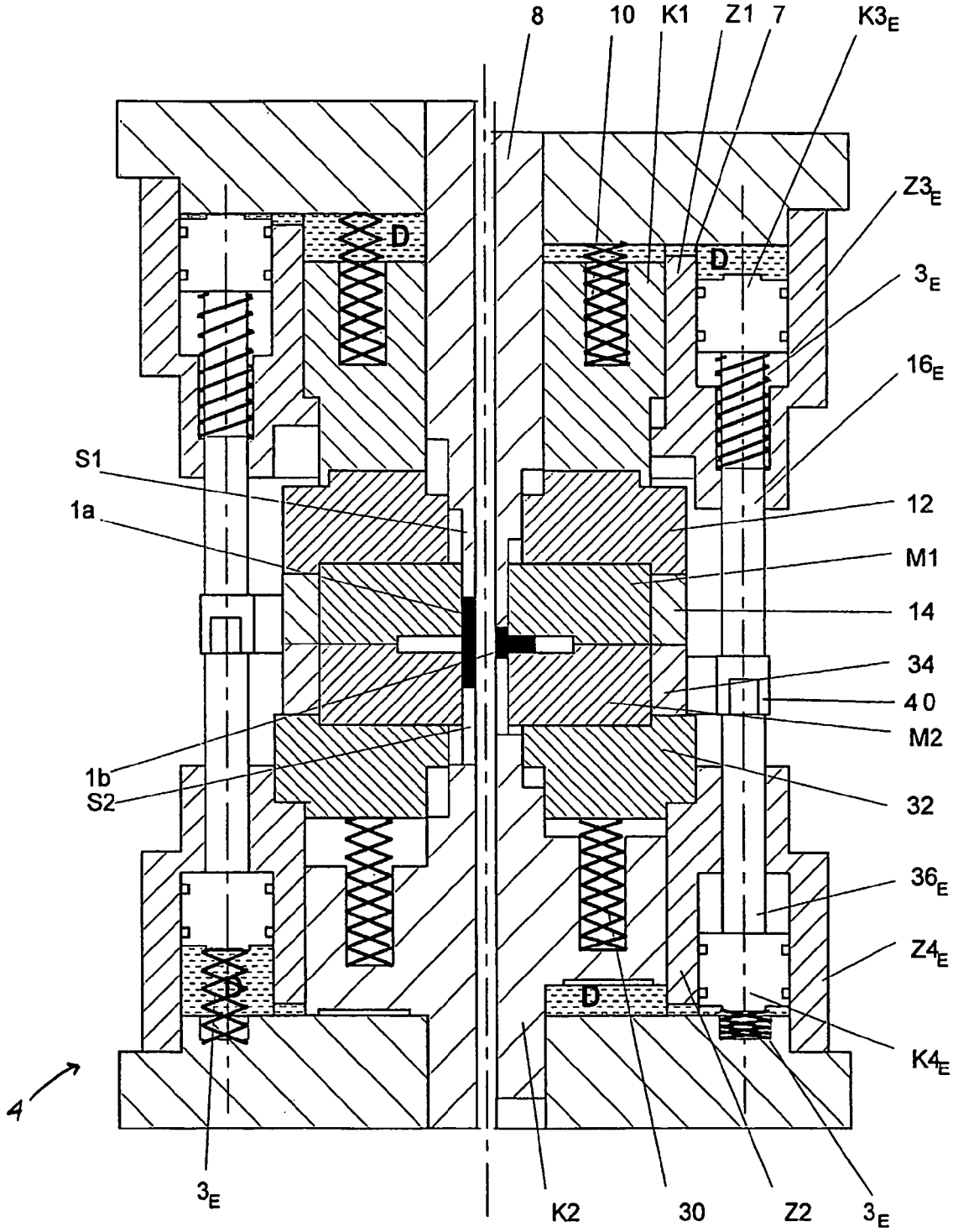
FIG. 2 shows a closing device of a second exemplary embodiment, in which the third and fourth hydraulic pistons are subdivided into a plurality of individual pistons.

The left-hand side of the representations in FIGS. 1 and 2 in each case shows the closed closing device with inserted blank 1*a*, and the right-hand side shows the closing device after completion of the lateral extrusion.

The closing device shown in FIG. 1 has a vertically movable top tool half and a bottom tool half fixed to the frame. The top tool half comprises an intermediate plate 6 which is fastened to the ram (not shown). A pressure piece 8, on which the first punch S1 sits, is arranged essentially centrally on the intermediate plate 6. Furthermore, the first hydraulic cylinder Z1 and the third hydraulic cylinder Z3 are fastened to the intermediate plate 6. The first hydraulic cylinder Z1 and the third hydraulic cylinder Z3 are designed as a construction unit, there being a connection in the form of a channel 7 between the hydraulic cylinders Z1 and Z3.

Guided in the first hydraulic cylinder Z1 is the first hydraulic piston K1, through which the pressure piece 8 projects. Pressure springs 10 are arranged between the first hydraulic piston K1 and the intermediate plate 6. Guided in the third hydraulic cylinder Z3 is a third hydraulic piston K3, on which a further pressure spring 3 is arranged in a radially encircling manner. The first die half M1, via a first die receptacle 12, is fastened to the first hydraulic piston K1 on the front face remote from the intermediate plate 6. The first die half M1 is enclosed by a clamping ring 14. A first pressure element 16 adjoins the third hydraulic piston K3.

The bottom tool half 4 consists of a base plate 26 which is fixed to the frame and on which the second hydraulic cylinder Z2 (on the inside) and the fourth hydraulic cylinder Z4 (on the outside) are arranged, likewise in such a way as to be fixed to the frame. The hydraulic cylinders Z2 and Z4 are likewise designed as a construction unit, there being a connection in the form of a channel 27 between the hydraulic cylinders Z2 and Z4. Guided in the hydraulic cylinder Z2 is an axially movable second hydraulic piston K2, on which the second punch S2 is arranged in the direction of the first punch S1. The second die half M2 is enclosed by a second clamping ring 34 and, in such a way that it is fixed to the frame, is connected to the construction unit consisting of the second and the fourth hydraulic cylinder Z2, Z4 via a second die receptacle 32, which acts as pressure plate 35. Pressure springs 30 are arranged between the second hydraulic piston K2 and the die receptacle 32. Guided in the fourth hydraulic cylinder Z4 is the fourth hydraulic piston K4, which has a second pressure element 36 in the direction of the first pressure element 16.

The first hydraulic piston K1 and the second hydraulic piston K2 are arranged on the inside and opposite one another and have the same piston areas. The third hydraulic piston K3 and the fourth hydraulic piston K4 are arranged on the outside and likewise in alignment opposite one another and are designed as annular pistons. The piston area of the fourth hydraulic piston K4 is reduced by 50% in relation to the effective piston area of the third hydraulic piston K3 in order to ensure that the first punch S1 and the second punch S2 perform a stroke movement by the same amount.

The first pressure element 16 arranged on the third hydraulic piston K3 and the second pressure element 36 arranged on the fourth hydraulic piston K4 are likewise of encircling, i.e. cylindrical, design and enclose the forming space in a sleeve shape during the lateral extrusion.

Figure 1A:
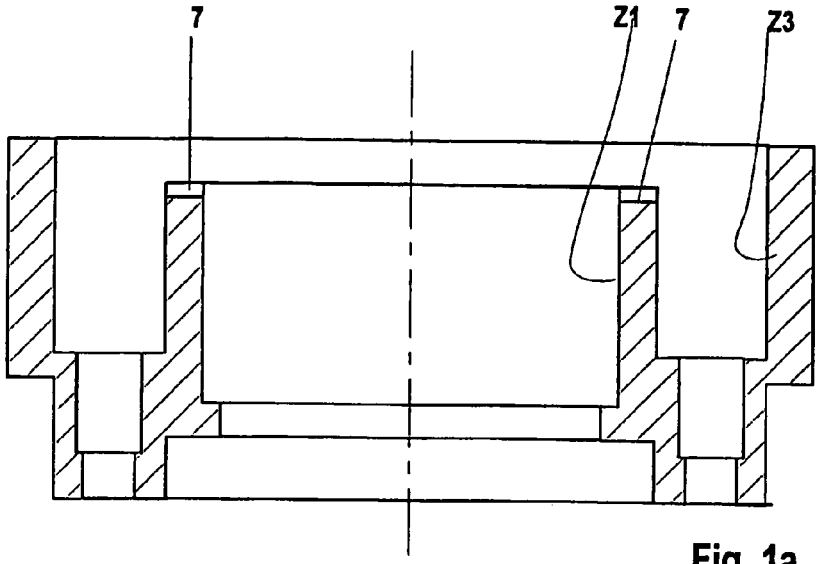
FIG. 1*a* shows a sectional representation of the construction unit, consisting of first hydraulic cylinder and third hydraulic cylinder, of the first exemplary embodiment.
Figure 1B:
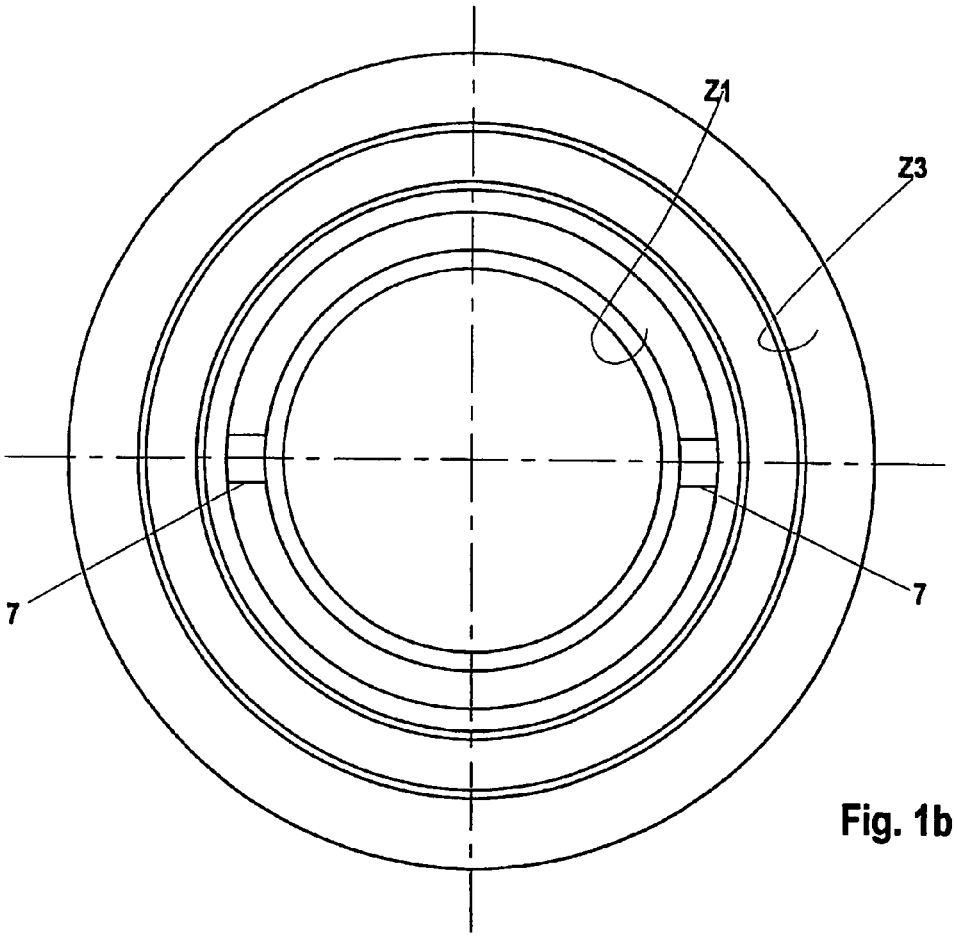
FIG. 1*b* shows a plan view of the construction unit according to FIG. 1*a;*

The sectional representation of the construction unit consisting of first hydraulic cylinder Z1 and third hydraulic cylinder Z3 is shown in FIG. 1*a* and the plan view is shown in FIG. 1*b*. It becomes clear from this that the closing device, in the top tool half, has a third cylinder which is designed as an annular cylinder and in which the third annular piston is guided. The construction unit consisting of second hydraulic cylinder Z2 and fourth hydraulic cylinder Z4 is of similar design.

The functioning of the closing device according to FIG. 1 is as follows:

After the blank 1*a* has been inserted, the top tool half with the intermediate plate 6 and the device elements fastened thereto is moved downward, so that the first die half M1 and the second die half M2 bear against one another and the first pressure element 16 and the second pressure element 36 touch one another (left-hand representation according to FIG. 1). The first hydraulic piston K1 and the second hydraulic piston K2 are located in the lowermost position, i.e. the first hydraulic piston K1 is at a distance from the intermediate plate 6, and the second hydraulic piston K2 bears with its underside against the base plate 26. The space above the first hydraulic piston K1 is filled with pressure medium D, and there is essentially no pressure medium under the second hydraulic piston K2. The third hydraulic piston K3 and the fourth hydraulic piston K4 located underneath are in the topmost position, i.e. the third hydraulic piston K3 bears against the intermediate plate 6, and the fourth hydraulic piston K4 is at a distance from the base plate 26. The space above the third hydraulic piston K3 is essentially emptied of pressure medium, and the space under the fourth hydraulic piston K4 is filled with pressure medium D.

If the ram together with the intermediate plate 6 performs a further feed movement, the first punch S1 presses the blank 1*a* against the second punch S2, and the intermediate plate 6 presses the third hydraulic piston K3 downward, as a result of which pressure medium is forced by the hydraulic piston K4 from the hydraulic cylinder Z4 via the channel 27 into the space under the second piston K2. If the requisite yield stress or applied pressure is achieved, the second hydraulic piston K2 together with the second punch S2 moves upward as a result, and at the same time the first punch S1 moves downward by the same amount. Owing to the fact that the hydraulic piston K1 is supported at the bottom, and in addition the first hydraulic cylinder together with the intermediate plate 6 moves downward, the space above the first hydraulic piston K1 is reduced in height, and the pressure medium D located therein is displaced via the channel 7 into the space above the third hydraulic piston K3, so that the latter together with the first pressure element 16, the second pressure element 36 and the fourth hydraulic piston K4 moves downward and further pressure medium D is forced out of the fourth hydraulic cylinder Z4 into the second hydraulic cylinder Z2. As a result, the material flows into the impression of the die. Due to the synchronism of the first and second punches S1, S2 with respect to the die halves, which are unaltered in their spatial position, the work piece is subjected to symmetrical forming, which is composed of axial compression and radial displacement into the cavity formed by the die halves. The pressure springs 10 and 30 are compressed during this forming operation. The right-hand representation in FIG. 1 shows the completed forming operation.

After completion of the forming operation, the press ram moves the top tool half upward again, in the course of which the first hydraulic piston K1 is shifted into its initial position by the restoring force of the pressure springs 10 and the second hydraulic piston K2 is shifted into its initial position by the pressure springs 30.

The work piece can now be removed in the same plane in which it has been inserted. This advantage becomes noticeable in particular in the case of automatic work piece manipulation.

Unlike the embodiment in FIG. 1, a closing device in which the third hydraulic piston is subdivided into a total of 6 third individual pistons $K3_E$ is shown in the representation according to FIG. 2. Accordingly, the third hydraulic cylinder Z3 is likewise subdivided into 6 third individual cylinders $Z3_E$, in which the third individual pistons $K3_E$ are guided. In this case, the third individual pistons $K3_E$ and the third individual cylinders $Z3_E$ are located on a common pitch circle.

Instead of the cylindrical first pressure element, a pressure rod 16E with a pressure spring $3_E$ is arranged on each third individual piston.

The fourth hydraulic piston is subdivided into three fourth individual pistons $K4_E$, which are guided in three fourth individual cylinders $Z4_E$. Instead of the cylindrical second pressure element, in each case a second pressure rod $36_E$ adjoins the fourth individual piston $K4_E$. An encircling pressure ring 40 is arranged on the ends of the second pressure rods $36_E$ in the direction of the first pressure rods $16_E$.

Figure 2A:
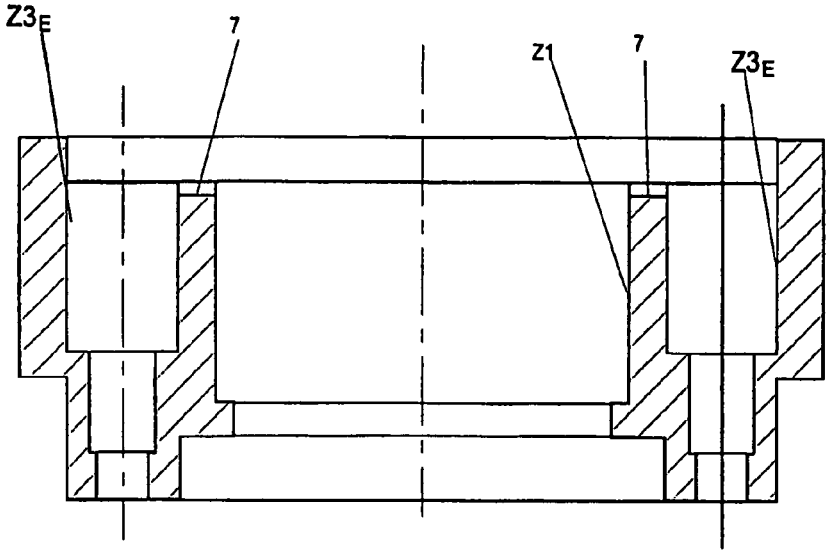
FIG. 2*a* shows a sectional representation of the construction unit, consisting of the first hydraulic cylinder and a plurality of third hydraulic cylinders, of the second exemplary embodiment.
Figure 2B:
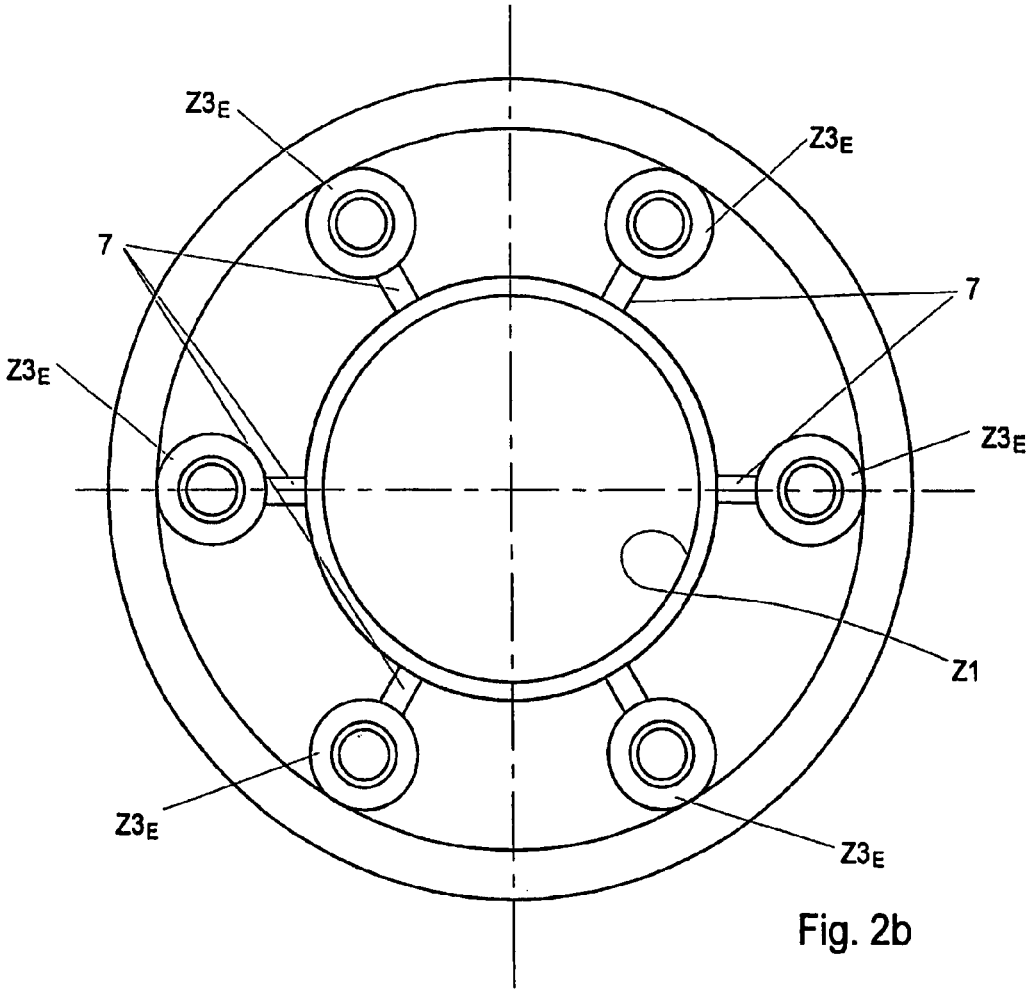
FIG. 2*b* shows a plan view of the construction unit according to FIG. 2*a*.

The sectional representation of the construction unit consisting of a first hydraulic cylinder Z1 and a total of 6 third individual cylinders $Z3_E$ according to FIG. 2 is shown in FIG. 2*a* and the plan view is shown in FIG. 2*b*. It becomes clear from this that, in the closing device, in the top tool half, the third cylinder is subdivided into a plurality of individual cylinders, to which in each case a third individual piston is assigned.

The construction unit consisting of a second hydraulic cylinder Z2 and a plurality of fourth individual cylinders $Z4_E$ is formed in a similar manner to the construction unit consisting of a first hydraulic cylinder Z1 and a plurality of third individual cylinders $Z3_E$; unlike the latter, however, only three fourth individual cylinders $Z4_E$ (and thus only three fourth individual pistons $K4_E$) are provided here.

The closing device according to FIG. 2 works according to the same principle as the closing device according to FIG. 1. The following changes have been made:

- the third hydraulic piston K3 designed as an annular piston has been replaced by 6 third individual pistons $K3_E$, a pressure spring $3_E$ being located under each third individual piston $K3_E$;
- the radially encircling third hydraulic cylinder Z3 has been replaced by 6 third individual cylinders $Z3_E$;
- the fourth hydraulic piston K4 designed as an annular piston has been replaced by 3 fourth individual pistons $K4_E$, a pressure spring $3_E$ being arranged as restoring spring under each fourth individual piston $K4_E$;
- the radially encircling fourth hydraulic cylinder Z4 has been replaced by 3 fourth individual cylinders $Z4_E$;
- first pressure rods $16_E$ are arranged as pressure elements on the third individual pistons $K3_E$;
- second pressure rods $36_E$ are arranged as pressure elements on the fourth individual pistons $K4_E$;
- a radially encircling pressure ring 40 is located between the first and the second pressure rods.

Figure 3:
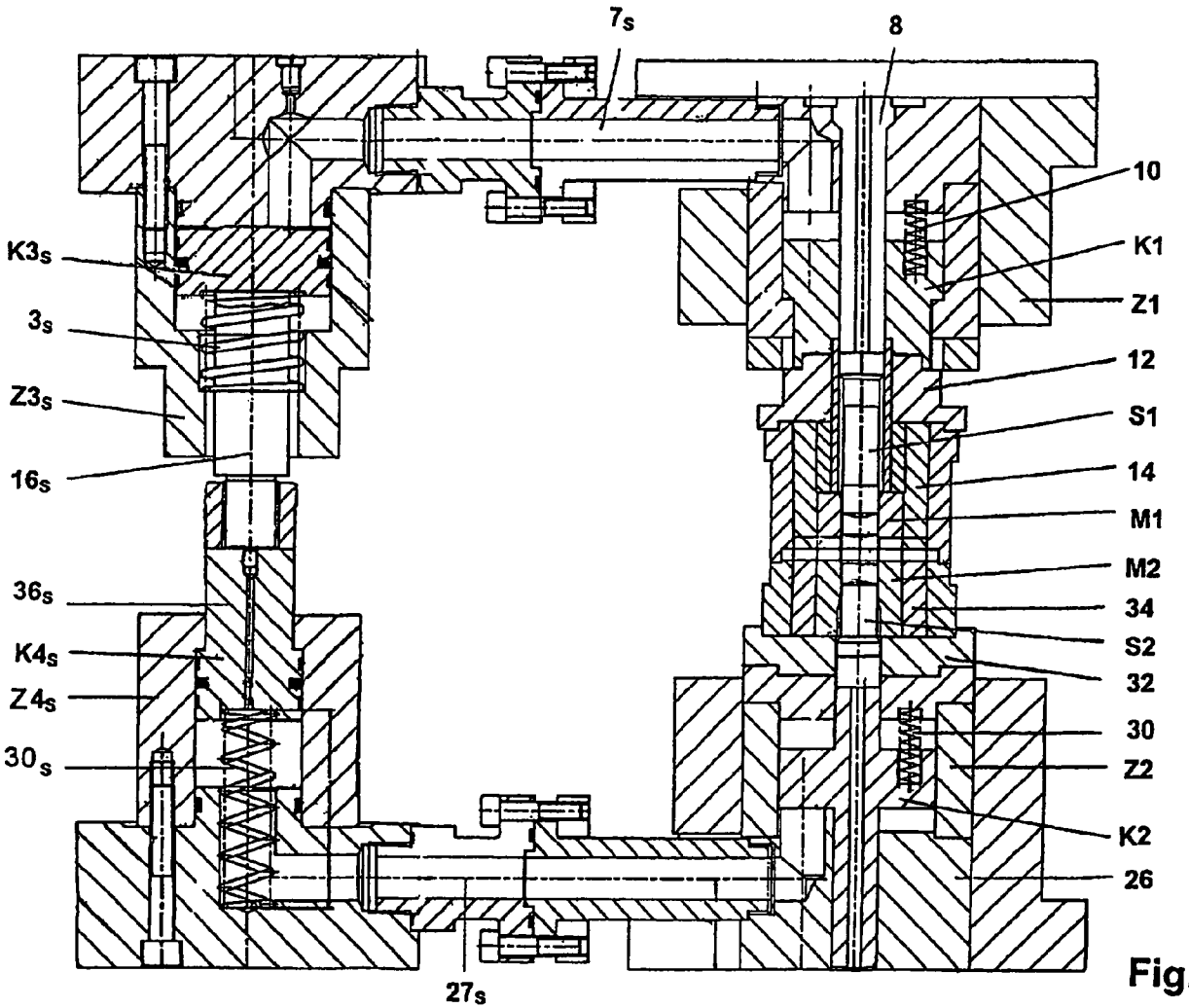
FIG. 3 shows a closing device of a third exemplary embodiment, in which a third and a fourth hydraulic piston are arranged to the side of the first and the second hydraulic cylinder, respectively.

Unlike the embodiment in FIG. 1, a closing device in which the third hydraulic piston is designed as a third individual piston $K3_S$ is shown in the representation according to FIG. 3. Accordingly, the third hydraulic cylinder is likewise designed as a third individual cylinder $Z3_S$, in which the third individual piston $K3_S$ is guided. The third individual piston $K3_S$ and the third individual cylinder $Z3_S$ are located to the side of the first hydraulic cylinder Z1. Instead of the cylindrical first pressure element, a pressure rod $16_S$ with a pressure spring $3_S$ is arranged on the third individual piston.

The fourth hydraulic piston is designed as a fourth individual piston $K4_S$, which is guided in the fourth individual cylinder $Z4_S$. Instead of the cylindrical second pressure element, a second pressure rod $36_S$ adjoins the fourth individual piston $K4_S$.

The third individual piston $K3_S$ and the fourth individual piston $K4_S$ are likewise arranged in alignment opposite one another. The effective piston area of the fourth individual piston $K4_S$ is likewise reduced by 50% in relation to the effective piston area of the third individual piston $K3_S$.

There is a connection in the form of a rigid pressure line $7_S$ between the first individual cylinder Z1 and the third individual cylinder $Z3_S$. There is a connection in the form of a rigid pressure line $27_S$ between the second individual cylinder Z2 and the fourth individual cylinder $Z4_S$.

The closing device according to FIG. 3 works according to the same principle as the closing device according to FIG. 1. The following changes have been made:

- the third hydraulic piston K3 designed as an annular piston has been replaced by a third individual piston $K3_S$, a pressure spring $3_S$ being located under the third individual piston $K3_E$;
- the radially encircling third hydraulic cylinder Z3 has been replaced by a third individual cylinder $Z3_S$;
- the fourth hydraulic piston K4 designed as an annular piston has been replaced by a fourth individual piston $K4_S$, a pressure spring $30_S$ being arranged as restoring spring under the fourth individual piston $K4_S$;

the radially encircling fourth hydraulic cylinder Z4 has been replaced by a fourth individual cylinder $Z4_S$;

a first pressure rod $16_S$ is arranged as pressure element on the third individual piston $K3_S$;

a second pressure rod $36_E$ is arranged as pressure element on the fourth individual piston $K4_S$;

the channel 7 between the first individual cylinder Z1 and the third individual cylinder $Z3_S$ has been replaced by a rigid pressure line $7_S$;

the channel 27 between the second individual cylinder Z2 and the fourth individual cylinder $Z4_S$ has been replaced by a rigid pressure line $27_S$.

On the whole, the invention provides a hydraulic closing device which has a simple and compact construction and in which external pressure lines to be moved and elastic pressure lines can be dispensed with.

Specific embodiments of a hydromechanical closing device, in particular for lateral extrusion according to the present invention have been described for the purpose of illustrating the manner in which the invention may be made and used. It should be understood that implementation of other variations and modifications of the invention and its various aspects will be apparent to those skilled in the art, and that the invention is not limited by the specific embodiments described. It is therefore contemplated to cover by the present invention any and all modifications, variations, or equivalents that fall within the true spirit and scope of the basic underlying principles disclosed and claimed herein.

The invention claimed is:

1. A hydromechanical closing device, in particular for lateral extrusion, having two die halves (M1, M2) which can be moved relative to one another and can be closed together, and two punches (S1, S2) which can be moved at the same speeds relative to the closed die halves (M1, M2), a first hydraulic piston (K1), on which the first die half (M1) is arranged, being mounted in a displaceable manner in an axially movable first hydraulic cylinder (Z1), and a second hydraulic piston (K2) being mounted in a displaceable manner in a second hydraulic cylinder (Z2) fixed to the frame, the second die half (M2) being fixed to the frame and the second punch (S2) being arranged on the second hydraulic piston (K2), characterized in that the first hydraulic cylinder (Z1) is connected to at least one third hydraulic cylinder (Z3; $Z3_E$; $Z3_S$), in which a third hydraulic piston (K3; $K3_E$; $K3_S$) is guided, the third hydraulic piston (K3; $K3_E$; $K3_S$), in the closed state of the closing device, acts on a fourth hydraulic piston (K4; $K4_E$; $K4_S$), which is guided in a fourth hydraulic cylinder (Z4; $Z4_E$; $Z4_S$) fixed to the frame, the first hydraulic cylinder (Z1) is connected to the third hydraulic cylinder (Z3; $Z3_E$; $Z3_S$) in such a way that the pressure medium (D) displaced from the first hydraulic cylinder (Z1) during a feed movement flows into the third hydraulic cylinder (Z3; $Z3_E$; $Z3_S$), so that the third hydraulic piston (K3; $K3_E$; $K3_S$) moves the fourth hydraulic piston (K4; $K4_E$; $K4_S$) in the feed direction, in such a way that pressure medium (D) is displaceable from the fourth hydraulic cylinder (Z4; $Z4_E$; $Z4_S$) by the fourth hydraulic piston (K4; $K4_E$; $K4_S$) into the second hydraulic cylinder (Z2) and thus the requisite forming pressure can be applied to the second hydraulic piston (K2), so that the punches (S1, S2) move toward one another.

2. The device as claimed in claim 1, characterized in that the third hydraulic piston (K3) and the fourth hydraulic piston (K4) are designed as annular pistons.

3. The device as claimed in claim 1 or 2, characterized in that the third hydraulic piston (K3; $K3_E$; $K3_S$) and the fourth hydraulic piston (K4; $K4_E$; $K4_S$) are arranged in alignment with one another.

4. The device as claimed in one of claims 1 to 3, characterized in that the volume of the pressure medium (D) which during the feed movement is displaced in the first and third hydraulic cylinders (Z1, Z3; $Z3_E$; $Z3_S$) is the same size as the volume of the pressure medium (D) displaced in the second and fourth hydraulic cylinders (Z2, Z4; $Z4_E$, $Z4_S$).

5. The device as claimed in one of claims 1 to 4, characterized in that the first hydraulic piston (K1) and the second hydraulic piston (K2) have the same piston areas.

6. The device as claimed in one of claims 1 to 5, characterized in that the piston area of the fourth hydraulic piston (K4; $K4_E$; $K4_S$) is established in accordance with the piston area of the second hydraulic piston (K2) and the distances covered by the third and fourth hydraulic pistons (K3, K4; $K3_E$, $K4_E$; $K3_S$, $K4_S$) during the feed movement.

7. The device as claimed in one of claims 1 to 6, characterized in that the piston area of the fourth hydraulic piston (K4; $K4_E$; $K4_S$) is halved in relation to the piston area of the third hydraulic piston (K3; $K3_E$; $K3_S$) if the fourth hydraulic piston (K4; $K4_E$; $K4_S$) covers twice the distance as the third hydraulic piston (K3; $K3_E$; $K3_S$).

8. The device as claimed in one of claims 1 to 7, characterized in that the third hydraulic piston is subdivided into a plurality of third individual pistons ($K3_E$) and/or the fourth hydraulic piston is subdivided into a plurality of fourth individual pistons ($K4_E$), the individual pistons ($K3_E$, $K4_E$) in each case being arranged on a common pitch circle.

9. The device as claimed in one of claims 1 to 8, characterized in that the third hydraulic cylinder is subdivided into a plurality of third individual cylinders ($Z3_E$) and/or the fourth hydraulic cylinder is subdivided into a plurality of fourth individual cylinders ($Z4_E$).

10. The device as claimed in one of claims 1 to 7, characterized in that the third hydraulic piston is designed as a third individual piston ($K3_S$) and the fourth hydraulic piston is designed as a fourth individual piston ($K4_S$), the individual pistons ($K3_S$, $K4_S$) being arranged in alignment opposite one another to the side of the first and second hydraulic cylinders (Z1, Z2).

11. The device as claimed in one of claims 1 to 8, characterized in that the third hydraulic cylinder is designed as a third individual cylinder ($Z3_S$) and the fourth hydraulic cylinder is designed as a fourth individual cylinder ($Z4_S$).

12. The device as claimed in one of claims 1 to 11, characterized in that the third hydraulic piston (K3; $K3_E$; $K3_S$) and the fourth hydraulic piston (K4; $K4_E$; $K4_S$) are connected via pressure elements (16, 36; $16_E$, $36_E$; $16_S$, $36_S$).

13. The device as claimed in claim 12, characterized in that the pressure elements (16, 36) are designed as pressure rods ($16_E$, $36_E$; $16_S$, $36_S$).

14. The device as claimed in one of claims 1 to 13, characterized in that the third hydraulic cylinder (Z3; $Z3_E$; $Z3_S$) is arranged on a press ram via an intermediate plate (6).

15. The device as claimed in one of claims 1 to 14, characterized in that the first punch (S1) is fastened to a pressure piece (8) connected to the ram.

16. The device as claimed in one of claims 1 to 15, characterized in that the second die half (M2) is arranged on the second hydraulic cylinder (Z2) in such a way as to be fixed to the frame.

17. The device as claimed in one of claims 1 to 16, characterized in that the hydraulic cylinders can be filled with pressure medium via a pressure line.

* * * * *